US006017422A

United States Patent [19]

Brox

[11] Patent Number: 6,017,422

[45] Date of Patent: Jan. 25, 2000

[54] SHOE PRESS

[75] Inventor: Erik Brox, Forshaga, Sweden

[73] Assignee: Valmet-Karlstad AB, Karlstad, Sweden

[21] Appl. No.: 09/163,764

[22] Filed: Sep. 30, 1998

Related U.S. Application Data

[60] Provisional application No. 60/064,757, Nov. 7, 1997.

[30] Foreign Application Priority Data

Sep. 30, 1997 [SE] Sweden ..... 9703568

[51] Int. Cl.[7] ..... D21F 3/00; D21H 11/00; B29C 43/46

[52] U.S. Cl. ..... 162/358.3; 162/358.4; 162/358.5; 162/361; 492/7

[58] Field of Search ..... 162/358.3, 358.4, 162/358.5, 361; 492/7

[56] References Cited

U.S. PATENT DOCUMENTS 5,033,176 7/1991 Schiel ..... 492/7
5,662,777 9/1997 Schiel et al. ..... 162/358.3

FOREIGN PATENT DOCUMENTS 0 345 501 12/1989 European Pat. Off. .
19515832C1 5/1996 Germany .

*Primary Examiner*—Peter Chin
*Assistant Examiner*—Dionne A. Walls
*Attorney, Agent, or Firm*—Alston & Bird LLP

[57] ABSTRACT

A shoe press for a paper or board machine comprises a press shoe and a counter roll forming an extended nip for a paper or cardboard web and for a circulated flexible belt. At least one hydraulic loading cylinder is arranged between a horizontal supporting beam included in the frame system of the shoe press and the counter roll for pressing the press shoe against the counter roll, the piston of the loading cylinder being fixed to the supporting beam. A hydrostatic compartment is arranged between the surface of the press shoe facing the loading cylinder and the opposing surface of the loading cylinder and adapted to be supplied with hydraulic fluid from a hydraulic fluid source, the hydraulic fluid chamber communicating with the working chamber of the loading cylinder. A duct formed in the press shoe, or in a pipe attached to the press shoe, opens into the hydrostatic compartment and is connectible to the hydraulic fluid source. A cylinder of the loading cylinder includes a tubular sleeve which extends into the working chamber toward the piston, a free end of the sleeve having a passage connecting the working chamber to the hydrostatic compartment. A throttling member fixed relative to the piston extends through the passage and is configured to close the passage when the cylinder moves a predetermined stroke distance away from the piston.

16 Claims, 1 Drawing Sheet

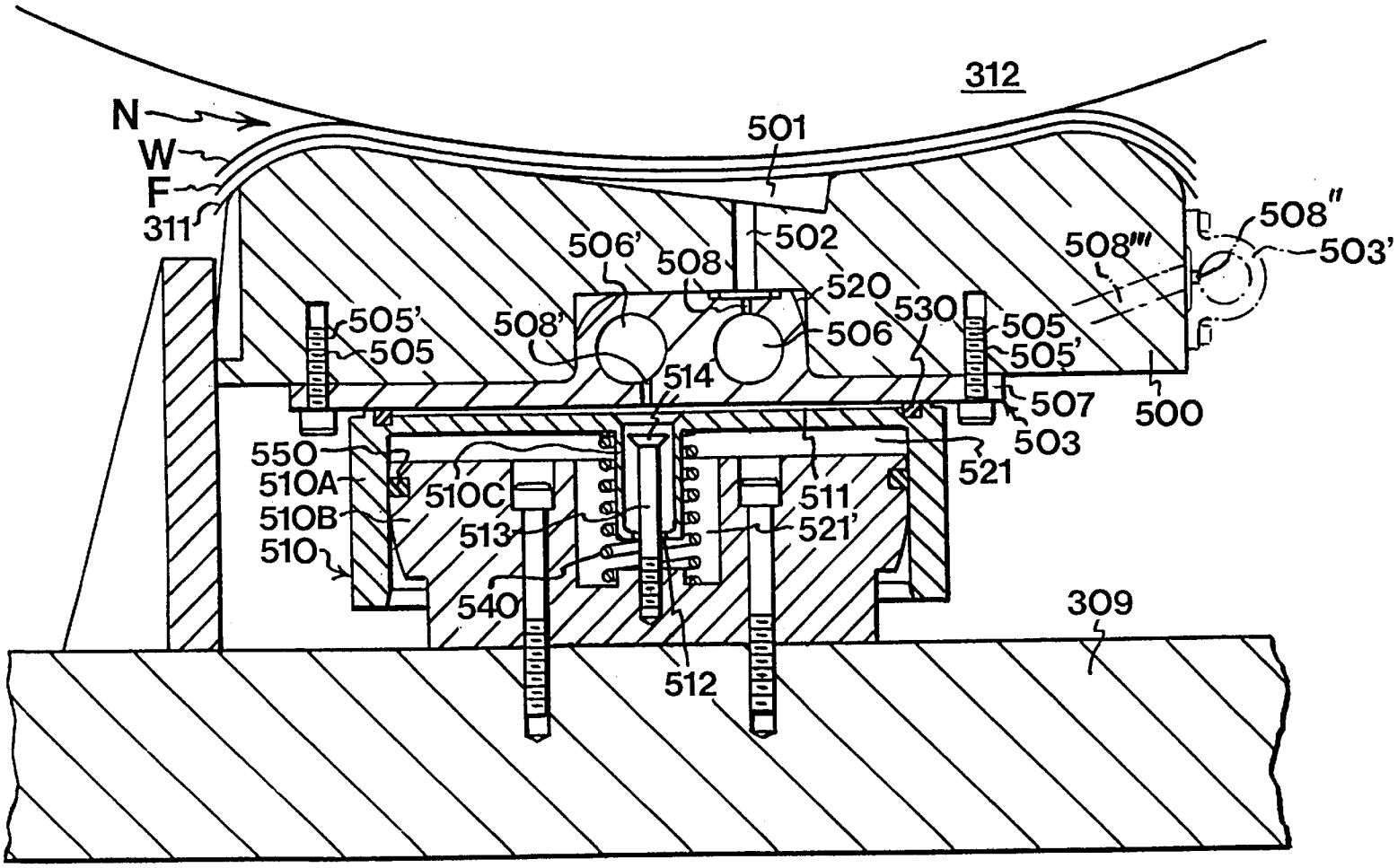
312
501
502
508
506'
508'
508'''
508''
503'
500
505
505'
507
503
520
506
530
521
511
521'
514
512
309
505'
505
510C
513
540
550
510A
510B
510
N
W
F
311

SHOE PRESS

CROSS-REFERENCE TO RELATED APPLICATION

This application claims priority to U.S. Provisional Patent Application Ser. No. 60/064,757, filed Nov. 7, 1997.

FIELD OF THE INVENTION

The present invention relates to a shoe press for pressing a running fibrous web of paper or the like in an extended nip formed between a press shoe and a counter roll.

BACKGROUND OF THE INVENTION

In a papermaking machine, devices are frequently employed for pressing a running fibrous web for various purposes. For example, in a press section of a papermaking machine, shoe presses are commonly used for pressing the web so as to remove water from the relatively wet web coming from the forming section of the machine. As another example, calendering of a web is frequently performed in a nip of a calender device for imparting desired surface characteristics to the web.

Shoe presses generally comprise a press shoe and a counter roll, which components form an extended nip between themselves for treating (e.g., dewatering when the shoe press is used in the press section of a paper or board machine) a paper or cardboard web. Furthermore shoe presses generally have pressurizable piston-and-cylinder units or loading cylinders which are distributed along the press shoe in one or more rows in the longitudinal direction of the press shoe and are operable for urging the press shoe toward the counter roll, see e.g. EP 345 501 B2, DE-195 15 832 C1, and DE 44 09 316 C1.

Sometimes shoe presses also comprise compartments which are formed in the upper surface facing the counter roll and which, in operation, contain fluid under hydrostatic pressure for lubricating the belt, see e.g. EP-345 501 B2. Such compartments are often called hydrostatic compartments or pockets.

Furthermore shoe presses may comprise a hydrostatic compartment or pressure chamber between each loading cylinder and the press shoe and which in operation contains fluid under hydrostatic pressure. The pressure chamber reduces sliding friction between the press shoe and loading cylinder surfaces such that the press shoe can more easily slide relative to the loading cylinders, see e.g. DE 195 15 832 C1.

The above-mentioned loading cylinders, compartments, and chambers thus require access to hydraulic fluid. The compartment for hydrostatic pressure according to EP-345 501 B2 is pressurized by hydraulic fluid through a duct which is horizontally bored in the longitudinal direction of the shoe press in the frame system of the shoe press and which is shared by all the compartments. Furthermore, in the shoe press disclosed in EP-345 501 B2, the working chambers of the loading cylinders are also pressurized by hydraulic fluid via ducts bored in the frame system of the shoe press. Similarly, DE 195 15 832 C1 also discloses a shoe press having ducts which are bored in the frame system of the shoe press and which are adapted to supply hydraulic fluid to the loading cylinders and as well as to pressure chambers between the press shoe and the loading cylinders. The working chambers of the loading cylinders are connected to the pressure chambers via throttles formed through the cylinder members of the loading cylinders.

Thus, in prior shoe presses, supply of fluid to the loading cylinders and/or hydrostatic compartments between the loading cylinders and the press shoe is accomplished via ducts formed in the frame systems of the shoe presses. The frame system of a shoe press typically is formed of steel beams, and accordingly, boring ducts through the frame system is a complicated and expensive procedure. Moreover, the bored ducts are of fixed geometry and thus are invariable and unalterable. There thus is a need of simplifying and making the supply of hydraulic fluid to the hydrostatic compartments, pressure chambers, and loading cylinders less expensive.

In the shoe press disclosed in DE 195 14 142 C1, there is a spring in the working chamber of the loading cylinder for sealingly pressing the loading cylinder against the press shoe and preventing hydraulic fluid from escaping sideways from the pressure chamber formed between the loading cylinder and the press shoe. The shoe press also has a number of tie-rod-spring arrangements which in pairs engage the press shoe on the longitudinal sides between the loading cylinders and which are operable for limiting the distance by which the press shoe can be moved away from the frame in the direction of the counter roll. The tie-rod-spring arrangements take up a considerable amount of space. There thus is also a need for a mechanism for limiting the movement or stroke of a press shoe which mechanism requires less space.

SUMMARY OF THE INVENTION

The above-mentioned needs are met and other advantages are realized by a shoe press in accordance with the present invention, in which fluid is supplied to the working chambers of loading cylinders as well as to hydrostatic compartments formed between the loading cylinders and the press shoe via ducts formed in the press shoe and/or in a supply member which is attached to the press shoe. Thus, the necessity of boring the frame system of the shoe press is eliminated.

To these ends, a preferred embodiment of a shoe press in accordance with the invention comprises a press shoe having opposite first and second sides, the first side adapted to coact with the counter roll to form an extended nip therebetween through which the running web is carried; a hydraulic loading cylinder adjacent the second side of the press shoe, the loading cylinder including a piston adapted to be affixed to a frame of the shoe press, and a tubular cylinder which slidably receives the piston, the piston and tubular cylinder defining a working chamber pressurizable with hydraulic fluid; a hydraulic fluid supply member attached to the press shoe and having a bore adapted to carry hydraulic fluid therein; a hydrostatic compartment formed between the second side of the press shoe and an end wall of the tubular cylinder and adapted to be supplied with hydraulic fluid, the hydrostatic compartment being fluidly connected with the working chamber by a passage formed through the end wall of the tubular cylinder; and a duct formed in one of the press shoe and the supply member, the duct opening into the hydrostatic compartment and being connected to the bore in the fluid supply member. Accordingly, both the hydrostatic compartment and the working chamber are supplied with hydraulic fluid via the duct which is formed outside of and separate from the frame system of the shoe press.

The invention in a preferred embodiment also provides a shoe press having a simple and compact mechanism for limiting the movement of the press shoe toward the counter roll. More particularly, the tubular cylinder includes a portion formed as a tubular sleeve which is open at both ends and is attached at one end to the end wall of the tubular cylinder and extends into the working chamber toward the piston and terminates at an opposite free end, the passage which connects the working chamber to the hydrostatic compartment being formed through the free end of the sleeve. An elongate throttling member is fixed relative to the piston and includes a body portion which extends through the passage into the interior of the sleeve and terminates at a head portion of the throttling member. The body portion is of smaller diameter than the passage such that fluid flows around the body portion through the passage. The head portion is of larger diameter than the passage and is configured to close the passage upon occurrence of a predetermined stroke of the cylinder away from the piston. Accordingly, when the cylinder moves the predetermined stroke distance away from the piston, the passage is closed by the throttling member and further pressurization of the hydrostatic compartment does not result in further movement of the cylinder away from the piston.

Advantageously, the shoe press also includes a resilient member disposed between the piston and the tubular cylinder for urging the cylinder toward the press shoe. The resilient member advantageously comprises a helical spring which surrounds the sleeve.

In a preferred embodiment of the invention, a hydrostatic pocket is formed in the first side of the press shoe, and a duct is formed in the press shoe for supplying hydraulic fluid to the hydrostatic pocket. The supply member preferably comprises a pipe attached to a side of the press shoe and having a hole through a side wall of the pipe. A duct is formed in the press shoe and is connected at one end to the hole in the pipe and at an opposite end to the hydrostatic pocket.

In a further preferred embodiment, the pipe has two bores, one of the bores communicating with the hydrostatic pocket in the first side of the press shoe facing the counter roll and the other bore communicating with the hydrostatic compartment between the loading cylinder and the press shoe. Advantageously, the pipe is at least partially disposed in a recess formed in the second side of the press shoe. The pipe includes an outer surface which opposes the loading cylinder and bounds one side of the hydrostatic compartment between the press shoe and the loading cylinder, and the duct which supplies fluid to the hydrostatic compartment is formed through a side wall of the pipe so as to connect the other bore with the hydrostatic compartment.

The invention thus enables a number of advantages relative to prior shoe presses. For example, the supply pipes for supplying fluid to the loading cylinders and compartments can be manufactured in a less expensive manner than precision-bored ducts in frame parts. Additionally, it is relatively easy and inexpensive to modify a shoe press provided with such a sectional pipe, for instance for altering the sizes of throttle passages of the fluid supply system, since the throttles can be formed within the supply pipes which are easily replaceable by other pipes having different throttle dimensions.

BRIEF DESCRIPTION OF THE DRAWING

The above and other objects, features, and advantages of the invention will become more apparent from the following description of a preferred embodiment thereof, when taken in conjunction with the accompanying drawing which depicts a cross-sectional view of the shoe press viewed in a cross-machine direction.

DETAILED DESCRIPTION OF A PREFERRED EMBODIMENT

The invention is now explained by reference to a preferred embodiment thereof. It is to be understood, however, that the present invention can be embodied in many different forms and should not be construed as being limited to the embodiment described herein; rather, this embodiment is presented so that this disclosure will be thorough and complete and will fully convey the scope of the invention to those skilled in the art. Like numbers refer to like elements throughout.

The FIGURE depicts a shoe press in cross-section viewed in a cross-machine direction. It will be understood that the press shoe 500 is a single piece which extends longitudinally in the cross-machine direction, whereas the loading cylinders 510, hydrostatic pockets 501, and hydrostatic compartments 511 described hereinbelow may be several in number and distributed in the longitudinal direction of the press shoe. Reference is now made to the drawing.

The shoe press includes a press shoe 500 and counter roll 312 which between themselves form an extended nip N through which a paper or cardboard web W is carried together with a circulated press belt 311 and one or more press felts F (only one shown). A horizontal beam included in the frame system of the shoe press is designated 309.

The press shoe 500 on its side facing away from the counter roll 312 is formed with a recess 520 that receives a straight sectional pipe 503. The sectional pipe 503 has flanges 507 by means of which the sectional pipe 503 is releasably secured to the press shoe by means of fasteners, for example screws 505 which engage holes 505' in the press shoe.

The sectional pipe 503 contains two parallel ducts 506, 506' extended in the longitudinal direction of the pipe. The duct 506 supplies hydraulic fluid, via bores 502 formed in the press shoe, to hydrostatic pockets 501 formed in the side of the press shoe 500 facing the counter roll 312. The hydraulic fluid has a lubricating effect on the press belt 311. The pipe 503 includes a throttle passage 508 formed through the wall of the pipe 503 facing the press shoe. The throttle connects the duct 506 in the pipe to the duct 502 in the press shoe, and serves to restrict the flow of hydraulic fluid to the hydrostatic pocket 501.

The duct 506' supplies hydraulic fluid, via a bore 508' in the wall of the sectional pipe 503 facing away from the press shoe, to the working chamber 521 in a hydraulic loading cylinder 510 which is formed of a cylinder 510A and a piston 510B slidably received in the cylinder. An O-ring seal between the piston 510B and the cylinder 510A is designated 550. The piston is screwed or otherwise fixed to the beam 309. The bore 508' is designed as a throttle such that any leakage of hydraulic fluid from one of the loading cylinders 510 does not affect the operation of the other loading cylinders to any great extent.

In the top surface of the cylinder 510A which confronts the opposing surface of the pipe 503 there is a recess forming a pressure chamber or hydrostatic compartment 511, which is delimited by an O-ring seal 530. The hydrostatic compartments 511 are pressurizable with hydraulic fluid such that the full forces exerted by the loading cylinders 510 on the press shoe 500 are not exerted by metal-to-metal contact between the loading cylinders and shoe, but rather are partially transmitted by fluid pressure. Accordingly, sliding frictional forces between the loading cylinder and the press shoe are reduced, facilitating relative sliding motion therebetween which may occur through thermal expansion during operation as well as through movement of the shoe against a downstream stop when the shoe press is started and frictional forces are exerted on the shoe by the belt 311 traveling through the nip N.

The throttle 508' leads from the bore 506' into the hydrostatic compartment 511. The hydrostatic compartment 511 thus also communicates with the working chamber 521. The hydrostatic compartment 511 is bounded on one side by the sectional pipe 503 as shown in the FIGURE. The hydrostatic compartment 511 is fluidly connected to the working chamber 521 via a tubular sleeve 510C which is open at both ends and has one of the ends attached to the end wall of the cylinder 510A. The other end of the sleeve 510C has a bottom opening 512. The sleeve forms part of the cylinder 510A and extends into a recess 521' in the piston 510B, which recess is part of the working chamber 521. In the bottom of this recess 521' a throttling member such as a screw 513 is fixed. The throttling member 513 extends through the opening 512 in the free end of the sleeve 510C. The body portion of the throttling member 513 is smaller in diameter than the opening 512 such that fluid can flow past the body portion through the opening 512. The free end of the throttling member 513 has a head 514 disposed within the sleeve 510C. The head 514 is greater in size than the bottom opening 512 of the sleeve and is configured to close the opening 512 when the cylinder 510A moves a predetermined stroke distance away from the piston 510B. A helical spring 540 surrounds the sleeve 510C and is biased between the bottom of the recess 521' and the underside of the cylinder 510A for sealingly pressing the cylinder 510A against the opposing surface of the pipe 503.

The sleeve 510C is dimensioned in consideration of the desired full stroke of the loading cylinder 510, such that when this full stroke has been achieved under the action of hydraulic fluid supplied to the working chamber 521, the head 514 of the screw 513 throttles the bottom opening 512. Upon further pressurization of the hydrostatic compartment 511, hydraulic fluid is forced to escape sideways from the hydrostatic compartment 511. The arrangement of the sleeve 510C, the throttling member 513, and the spring 540 can thus be regarded as a stroke-limiting mechanism for the loading cylinder.

It should be emphasized that the invention is not limited to the placing of the sectional pipe on the underside of the press shoe. A sectional pipe for supplying fluid to the hydrostatic compartments 511 and, if desired, also the hydrostatic pockets 501, can alternatively be releasably attached to a longitudinal side edge of the press shoe 500, as indicated by dashed lines and reference numeral 503'. In this case, a throttle 508" is formed in the pipe wall communicating with a bore 508"' formed in the press shoe 500 and opening into the hydrostatic compartment 511.

While the shoe press has been described as being useful in a pressing section of a papermaking machine, an apparatus in accordance with the invention can also be used in a calender section of a papermaking machine.

Many modifications and other embodiments of the invention will come to mind to one skilled in the art to which this invention pertains having the benefit of the teachings presented in the foregoing description and accompanying drawing. Therefore, it is to be understood that the invention is not to be limited to the particular embodiment illustrated and described herein, and that modifications, substitutions of equivalents, and other embodiments are intended to be included within the scope of the appended claims. Although specific terms are employed herein, they are used in a generic and descriptive sense only and not for purposes of limitation.

What is claimed is:

1. A shoe press for pressing a running fibrous web against a counter roll, comprising:

a press shoe having opposite first and second sides, the first side adapted to coact with the counter roll to form an extended nip therebetween through which the running web is carried;

a hydraulic loading cylinder adjacent the second side of the press shoe, the loading cylinder including a piston adapted to be affixed to a frame of the shoe press, and a tubular cylinder which slidably receives the piston, the piston and tubular cylinder defining a working chamber pressurizable with hydraulic fluid;

a hydraulic fluid supply member attached to the press shoe and having a bore adapted to carry hydraulic fluid therein;

a hydrostatic compartment formed between the second side of the press shoe and an end wall of the tubular cylinder and adapted to be supplied with hydraulic fluid, the hydrostatic compartment being fluidly connected with the working chamber by a passage formed through the end wall of the tubular cylinder; and a duct formed in one of the press shoe and the supply member, the duct opening into the hydrostatic compartment and being connected to the bore in the fluid supply member, whereby both the hydrostatic compartment and the working chamber are supplied with hydraulic fluid via the duct.

2. The shoe press of claim 1, wherein the tubular cylinder includes a portion formed as a tubular sleeve which is open at both ends and is attached at one end to the end wall of the tubular cylinder and extends into the working chamber toward the piston and terminates at an opposite free end, the passage which connects the working chamber to the hydrostatic compartment being formed through the free end of the sleeve.

3. The shoe press of claim 2, further comprising an elongate throttling member fixed relative to the piston and including a body portion which extends through the passage into the interior of the sleeve and terminates at a head portion of the throttling member, the body portion being of smaller diameter than the passage such that fluid flows around the body portion through the passage, the head portion being of larger diameter than the passage and configured to close the passage upon occurrence of a predetermined stroke of the cylinder away from the piston.

4. The shoe press of claim 3, further comprising a resilient member disposed between the piston and the tubular cylinder for urging the cylinder toward the press shoe.

5. The shoe press of claim 4, wherein the resilient member comprises a helical spring which surrounds the sleeve.

6. The shoe press of claim 1, further comprising a hydrostatic pocket formed in the first side of the press shoe, and a duct formed in the press shoe for supplying hydraulic fluid to the hydrostatic pocket.

7. The shoe press of claim 6, wherein the supply member comprises a pipe attached to a side of the press shoe and having a hole through a side wall of the pipe, and a duct formed in the press shoe and connected at one end to the hole in the pipe and at an opposite end to the hydrostatic pocket.

8. The shoe press of claim 7, wherein the pipe has two bores, one of the bores communicating with the hydrostatic pocket in the first side of the press shoe facing the counter roll and the other bore communicating with the hydrostatic compartment between the loading cylinder and the press shoe.

9. The shoe press of claim 8, further comprising a recess formed in the second side of the press shoe, and wherein the pipe is at least partially disposed in the recess.

10. The shoe press of claim 9, wherein the pipe includes an outer surface which opposes the loading cylinder and bounds one side of the hydrostatic compartment between the press shoe and the loading cylinder, the duct which supplies fluid to the hydrostatic compartment being formed through a side wall of the pipe so as to connect said other bore with the hydrostatic compartment.

11. The shoe press of claim 7, wherein the pipe has flanges forming attachment portions for releasably affixing the pipe to the press shoe.

12. A shoe press for pressing a running fibrous web against a counter roll, comprising:

a press shoe having opposite first and second sides, the first side adapted to coact with the counter roll to form an extended nip therebetween through which the running web is carried;

a hydraulic loading cylinder adjacent the second side of the press shoe, the loading cylinder including a piston adapted to be affixed to a frame of the shoe press, and a tubular cylinder which slidably receives the piston, the piston and tubular cylinder defining a working chamber pressurizable with hydraulic fluid; and a duct arranged adjacent to the press shoe and opening into the tubular cylinder through a passage in an end wall of the tubular cylinder such that the working chamber is supplied with hydraulic fluid via the duct; and a throttling member fixed relative to the piston and extending through the passage in the end wall of the tubular cylinder, the throttling member being configured to close the passage when the cylinder is in a predetermined position relative to the piston.

13. The shoe press of claim 12, wherein the tubular cylinder includes a portion formed as a tubular sleeve which is open at both ends and is attached at one end to the end wall of the tubular cylinder and extends into the working chamber toward the piston and terminates at an opposite free end, the passage which connects the working chamber to the duct being formed through the free end of the sleeve.

14. The shoe press of claim 13, wherein the throttling member includes a body portion which extends through the passage into the interior of the sleeve and terminates at a head portion of the throttling member, the body portion being of smaller diameter than the passage such that fluid flows around the body portion through the passage, the head portion being of larger diameter than the passage and configured to close the passage upon occurrence of a predetermined stroke of the cylinder away from the piston.

15. The shoe press of claim 14, further comprising a resilient member disposed between the piston and the tubular cylinder for urging the cylinder toward the press shoe.

16. The shoe press of claim 15, wherein the resilient member comprises a helical spring which surrounds the sleeve.

* * * * *